United States Patent [19]

Zunkel

[11] 4,429,490

[45] Feb. 7, 1984

[54] DOOR CONTROL SWITCHING DEVICE

[75] Inventor: Richard L. Zunkel, Princeton, Ill.

[73] Assignee: Schlage Lock Company, San Francisco, Calif.

[21] Appl. No.: 353,622

[22] Filed: Mar. 1, 1982

[51] Int. Cl.[3] ..... E05F 15/10

[52] U.S. Cl. ..... 49/32; 49/340

[58] Field of Search ..... 49/32, 340, 345; 200/153 L

[56] References Cited

U.S. PATENT DOCUMENTS

| | | | |
|---|---|---|---|
| 1,684,704 | 9/1928 | Hubbell | 49/32 X |
| 2,334,452 | 11/1943 | Strobell | 49/32 X |
| 3,084,927 | 4/1963 | Linder | 49/340 X |
| 4,040,144 | 8/1977 | Lasier | 49/32 X |
| 4,251,009 | 2/1981 | McLaughlin et al. | 49/340 X |

*Primary Examiner*—Philip C. Kannan

*Attorney, Agent, or Firm*—Lothrop & West

[57] ABSTRACT

Especially for use with a door panel hinged on a frame for relative swinging movement is a device for so swinging the panel relative to the frame, the swinging device being responsive to a switch. An arm journalled on an eccentric hub rotatable with the door frame is movable in one direction against a stop and in the other direction against a switch that controls the operation of the panel swinging device, in this way affording an easy and proper control of power door operation.

10 Claims, 18 Drawing Figures

FIG-1
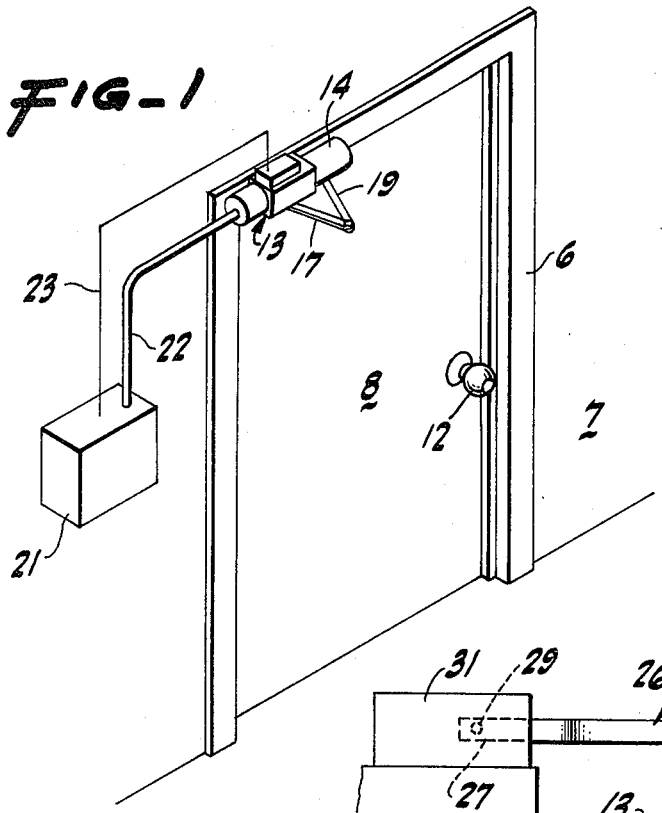
FIG-2
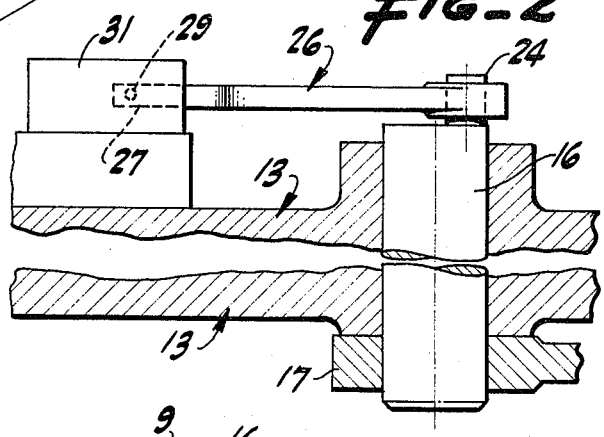
FIG-4
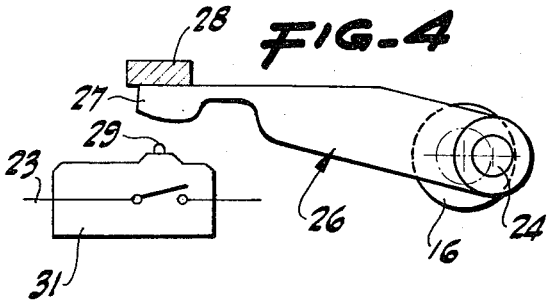
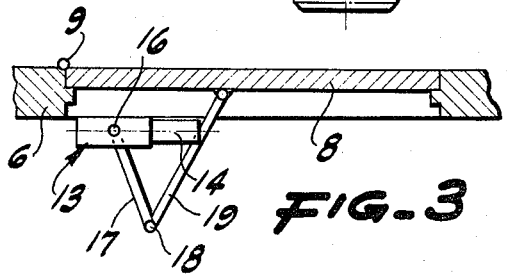
FIG-3
FIG-6
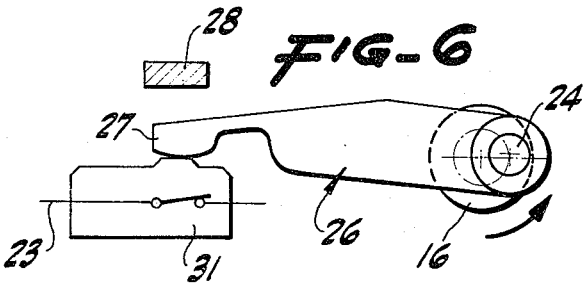
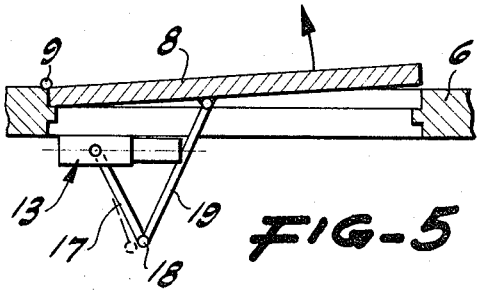
FIG-5

DOOR CONTROL SWITCHING DEVICE

BRIEF SUMMARY OF THE INVENTION

The invention relates to structure for use in connection with a door panel that is mounted on a door frame by hinges in order to swing between a closed position and any of several, chosen open positions, the motion of the door panel being subject to some damping or other sort of control and sometimes being effectuated by power. If power is utilized, it is preferably initiated or controlled by the operator starting the motion of the door panel with respect to the door frame.

One form of structure for carrying out the purposes of the invention is described in the accompanying description and is illustrated in the accompanying drawings.

BRIEF DESCRIPTION OF THE SEVERAL VIEWS OF THE DRAWINGS

FIG. 1 is a diagrammatic, isometric view showing a door panel in closed position and mounted by hinges on a frame and having an appropriate controlling structure pursuant to the invention.

FIG. 2 is a side elevation, with portions in section, of an actuator.

FIG. 3 is a diagram in horizontal cross-section showing the door panel in closed position.

FIG. 4 is a corresponding plan view of some of the control structure positioned accordingly.

FIG. 5 is a diagrammatic view largely in horizontal cross-section showing the door panel partly open.

FIG. 6 is a view comparable to FIG. 4 and showing the control structure in a position corresponding to that of the door panel of FIG. 5.

DETAILED DESCRIPTION

Figure 8:
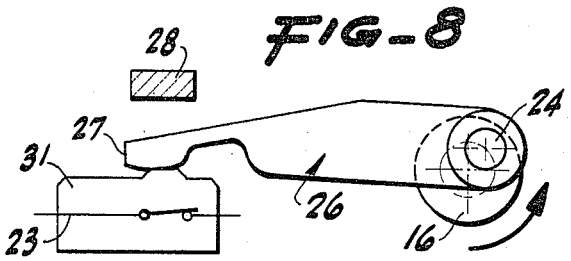
FIG. 8 is a view like FIG. 6 but showing the control mechanism advanced corresponding to the FIG. 7 door panel position.

In the usual arrangement, as especially shown in FIG. 1, there is provided a door frame 6 generally of a rectangular configuration and marking a passage through a wall 7 closed in one position of a door panel 8 and open in another position thereof. The door panel 8 is mounted on the frame by hinges 9 and 11 and has the customary control hardware 12 thereon. In addition, there is provided a special form of door controlling mechanism 13, which will appear more fully hereinafter. In the controlling arrangement, there is an internal structure, usually actuating against a closing spring (not shown) in a housing 14. The spring is compressed upon rotation of a shaft 16 in one direction by a lever arm 17 connected by a pivot pin 18 to a link arm 19 fastened pivotally to the door panel 8. As the door panel 8 is swung open on the hinges, the spring in the housing 14 is compressed and tends of its own accord to close the door panel. Such closure is often controlled by means of a hydraulic piston and cylinder arrangement including bleed holes that are variable, so that the closing speed in different zones can be variously regulated.

In the present instance, the mechanism 13 is not only inclusive of the customary hydraulic closer structure, but in addition there is a second pneumatic arrangement. This is joined to a power source 21 and is effective to supply compressed air under a selected pressure through a line 22 to the hydraulic cylinder. The source 21 is controlled electrically or pneumatically from the controller 13 through a line 23. When the door is to be opened, the power source 21 is made effective to add to the opening force for swinging the door panel 8 relative to the door frame 6. It can also be arranged for the hydraulic force to be effective in assisting in bringing the door through a regulated closing pattern, if desired.

The power source 21 is shown diagrammatically because it need not be pneumatic, but instead can be of a generally mechanical or electrical nature, working with an electrical control structure with the mechanism 13. The point in each instance is that there is available to move the panel with respect to the frame a suitable power actuator so that such movement does not have to be done by hand and is not subject to variant forces such as slamming or winds or the like, particularly when the door is in the fully open position.

Whatever the nature of the power source and of the corresponding controller 13, there is provided a structure responsive to door panel position to regulate the appropriate panel-influencing force. As an exemplary device, there is provided on the end of the shaft 16 an eccentrically located hub 24. On the hub 24 is a trigger arm 26 extending radially from the hub so that the tip 27 of the arm 26 is movable between a fixed stop 28 and the contact 29 of a switch 31 controlling the circuit 23.

Since the hub 24 may swing though an eccentric arc substantially different in length than the space within which the lever arm 26 may swing, there is provided a firm but frictional engagement between the hub 24 and the surrounding end of the arm 26. Thus, while when there is no particular restraint the arm and hub 24 rotate together, yet when the arm strikes an obstruction and cannot move farther, even so the hub 24 can continue by rotating within the end of the arm.

The functioning of the parts is substantially as set forth in the various progressive views. When the door is closed, as in FIGS. 3 and 4, the hub 24 and the arm 26 are in a relationship so that the tip 27 of the arm is in abutment with a fixed stop 28. The tip of the arm is likewise spaced from the contact 29.

As the door panel 8 starts to swing open from the position of FIG. 3 into the position of FIG. 5, the shaft 16 is rotated and carries the hub 24 with it. Likewise, being unrestrained, the arm 26 similarly swings and moves away from the fixed stop 28 and into abutment with the contact 29 and thus energizes or closes the otherwise open spring switch 31. Thus, the merest opening of the door panel by hand calls upon an auxiliary assisting opening force from the power source 21, since the circuit 23 is then closed.

Figure 7:
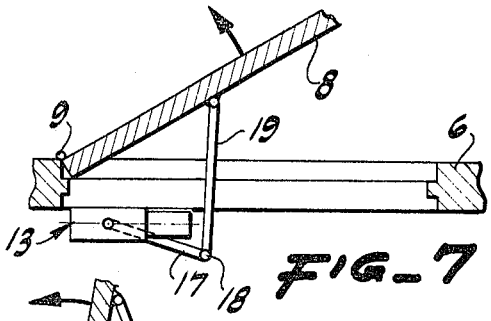
FIG. 7 is a view of the door panel in a further open position.

As the door panel then swings farther toward an open position, as shown in FIG. 7, and the shaft 16 also rotates farther, the hub 24 is carried around with the shaft 16. The arm 26, being in abutment with the switch 31, cannot move any farther in a switch-closing direction, but merely slides laterally or shifts laterally slightly to the left in FIG. 8 while keeping the contact still closed.

Figure 10:
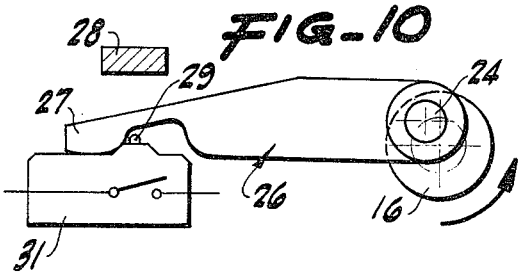
FIG. 10 is a diagrammatic view of the control structure in a position corresponding to that of the door of FIG. 9.
Figure 9:
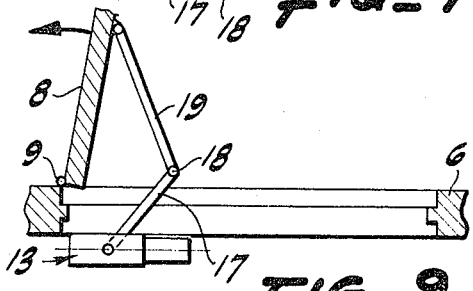
FIG. 9 is a view comparable to FIG. 7 but with the door much more nearly open.

As the door panel opening movement continues, as illustrated in FIG. 9, the shaft 16 rotates farther in a counterclockwise direction and carries the hub 24 farther around with it toward the left as seen in FIG. 10. This motion, although still urging the arm 26 toward the switch, also shifts the arm farther transversely so that the tip 27 of the arm is moved out of or away from contact with the switch 31. Then the switch 31 opens under the customary spring pressure and breaks the circuit to the power device 21. By this means, the door is open sufficiently for most normal purposes and there is no longer a demand for auxiliary opening force. The power source may continue to supply power to the controlling mechanism for any predetermined time, but the door remains stationary in the open position, as the motion limit of the door controller internal structure has been reached.

Figure 11:
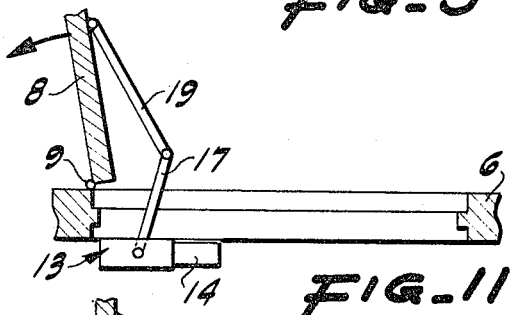
FIG. 11 is a view of the door panel somewhat past central open position.

Even so, as shown in FIG. 11, the door panel 8 may swing to a farther open position, and when that occurs the shaft 16 continues to rotate counterclockwise in an additional amount. The hub 24 goes with it, yet cannot displace the arm 26 any farther toward the body of the switch 31, but rather simply shifts transversely or laterally and away from the contact 29, so that the circuit remains open and no additional demand signal is sent to the power device 21.

This is substantially the openmost position of the door panel and requires nothing to position it other than the standard restraint of the door closer mechanism itself.

Figure 12:
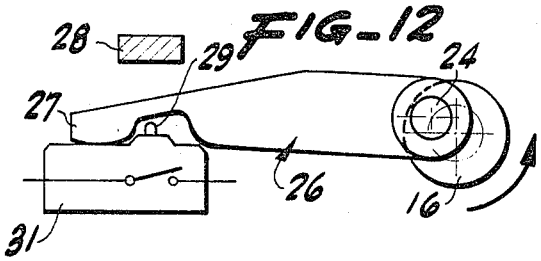
FIG. 12 is a view of the control structure in a location corresponding to the door panel position of FIG. 11.
Figure 14:
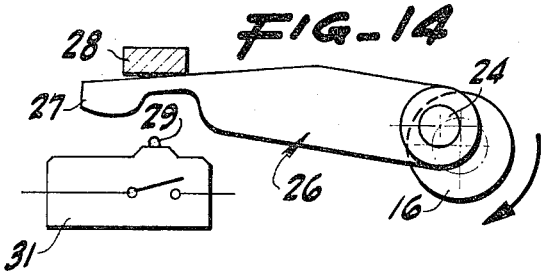
FIG. 14 is a view of the control structure corresponding to the door panel position of FIG. 13.
Figure 13:
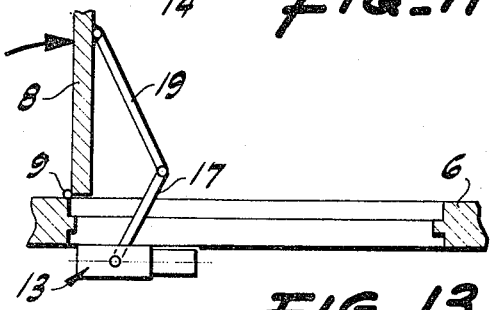
FIG. 13 is a diagrammatic view of the door panel retracing its motion from fully open toward a closed position.
Figure 16:
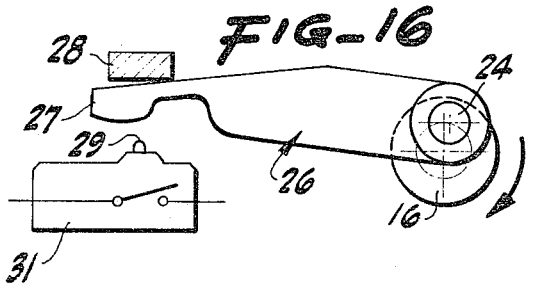
FIG. 16 is a view like FIG. 14 but with the parts in position for the door panel location of FIG. 15.

When it is time to close the door, or the spring in the closer starts to close the door, as shown in FIG. 13, then the door panel 8 begins to move in a clockwise direction and correspondingly starts to rotate the shaft 16 in a clockwise direction. Concurrently with that, the hub 24 is likewise translated in a clockwise direction and due to friction with the arm 26 causes the arm to move away from the switch and again into contact with the stop 28, as indicated by the difference in position between FIGS. 12 and 14. The switch 31, having been opened, remains open because there is no further force upon it.

Figure 15:
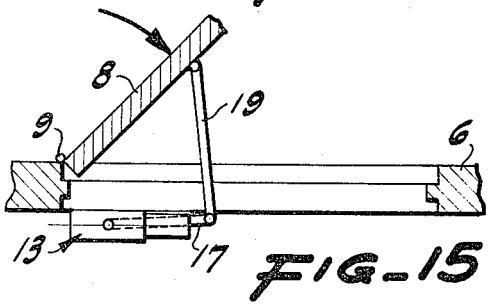
FIG. 15 is a view of the door panel approaching closed position.

As the door panel 8 continues toward closed position, as shown in FIG. 15, the shaft 16 likewise continues in its clockwise rotation, carrying the hub 24 with it. Under these circumstances, the tip of the arm 26 simply slides over or against the stop 28 without any abutment with the contact. The tip 27 of the arm 26 is brought into juxtaposition with the switch contact 29 so that any subsequent opening motion of the door will cause the tip 27 to operate the switch 31, thus causing an opening assist from that point until the door reaches the fully open position.

Figure 18:
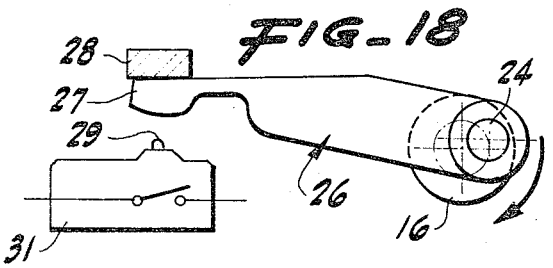
FIG. 18 is a view of the control mechanism in a position corresponding to the door position of FIG. 17.
Figure 17:
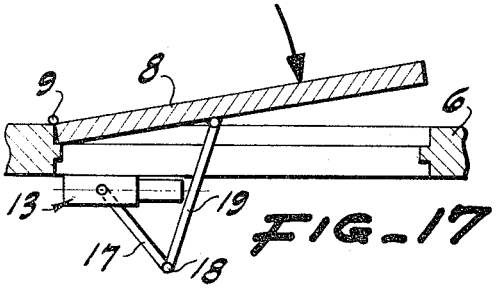
FIG. 17 is a view of the door panel very nearly closed again.

Finally, when the door panel 8 is nearly in its closed position again, as shown in FIG. 17, the shaft 16 has very nearly returned to its initial rotary position and has brought the stub shaft 24 very nearly back to its initial position. Under these circumstances, the arm 26 is likewise shifted transversely since it cannot rotate any farther because of restraint by the stop 28. The arm simply shifts transversely or laterally toward the right in FIG. 18 and substantially into the position that it occupied as shown in FIG. 4 except for a slight transverse displacement. The transverse position of the tip 27 now is such that when the door panel 8 is again moved toward open position, the counterclockwise rotation of the shaft 16 and of the hub 24 through friction with the arm 26 causes the arm to rotate in a counterclockwise direction. This brings the tip 27 downwardly in FIG. 18 and again into touch with the contact 29, so that the circuit 23 is again completed and there is again power actuation of the door panel toward open position.

Thus by very simple means, there is afforded a way of controlling a power actuator for a door panel effective in the position of the panel near or in its closed position but ineffective when the door panel is substantially open and does not require any additional force. The operation of the door panel by a person is greatly facilitated and permits him to start the opening of a door relatively easily and then to be substantially assisted for the remaining part of the desired door opening. There is also in effect a resetting of the device when the door panel closes, so that the next user has the same advantage.

I claim:

1. In a door control switching device for a door panel hinged to rotate in a door frame and having a shaft rotatable about an axis and interconnected with said panel and said frame for rotation of said shaft into rotary positions corresponding to the rotary positions of the door panel in the door frame and having means incorporating a controlling switch contact for rotating said panel relative to said frame, the combination of a hub projecting eccentrically from said shaft, an arm having opposite ends, and means disposing one of said ends frictionally engaging said hub for movement of one of said ends in an orbital path relative to said shaft axis and disposing the other of said ends freely alongside said switch for arcuate movement directly toward and away from abutment with said switch contact and for another movement normal to said arcuate movement and transversely across said switch contact between a first position and a second position.

2. A device as in claim 1 including a stop, means for fixing said stop with respect to said switch contact and in a position on the side of said other of said arm ends opposite said switch contact.

3. A device as in claim 1 including means on said arm constituting a reduced shank and an enlarged end, and in which said arm in said first position is disposed with said reduced shank adjacent said switch contact and in said second position is disposed with said enlarged head adjacent said switch contact.

4. A door control switching device for a door panel hinged to swing in a door frame and having a rotary shaft adapted to occupy rotary positions corresponding to the rotary positions of the door panel in the door frame and having means for swinging said door panel relative to said frame, including a circuit controlling switch for actuating said swinging means, comprising an arm, and means for moving said arm arcuately toward and away from said switch into and out of a position actuating said switch and for moving said arm transversely of said switch into and out of a position actuating said switch.

5. A device as in claim 4 including a stop, means for mounting said stop stationarily relative to said switch and in the path of said arm moving arcuately away from said switch.

6. A door control switching device for use with a door frame having an opening therein, a door panel, means for mounting said door panel on said door frame for rotation of said door panel into and out of said opening, a shaft, means fixed relative to said door frame for mounting said shaft for rotation relative to said door frame about a shaft axis, and means for interconnecting said shaft and said door panel for rotation of said shaft about said shaft axis corresponding to said rotation of said door panel, said switching device comprising an arm having opposite ends, means for frictionally engaging one of said ends with said shaft both for rotation of said arm in a predetermined path together with said rotation of said shaft and also for rotation of said arm relative to said shaft, a switch operable between open position and closed position, means for mounting said switch stationarily with respect to said door frame and in said predetermined path in a position to be operated by the other of said ends of said arm, a stop, and means for mounting said stop stationarily with respect to said door frame in said predetermined path in position to be engaged by said other of said ends of said arm.

7. A device as in claim 6 including means for locating said switch and said stop on opposite sides of said other one of said ends of said arm.

8. A device as in claim 6 in which said means for engaging said one of said ends of said arm with said shaft includes a hub secured to said shaft in position with the hub axis eccentric to said shaft axis, and in which the other of said ends of said arm is unattached.

9. A device as in claim 6 in which said switch has an open position and a closed position and is spring biased to open position.

10. A device comprising a shaft having a shaft axis, stationary means for mounting said shaft for rotation about said shaft axis, a hub having a hub axis, means for mounting said hub on said shaft with said hub axis parallel with and eccentric to said shaft axis, an arm having a remote end and having a bearing end, means for frictionally journalling said bearing end on said hub for movement of said arm together with said hub about said shaft axis when said remote end is free and for movement of said arm relative to said hub about said hub axis when said remote end is restrained.

* * * * *